US007341157B2

(12) United States Patent
Slobogean et al.

(10) Patent No.: US 7,341,157 B2
(45) Date of Patent: Mar. 11, 2008

(54) ENCLOSED-REEVING, LIVE-LINE BOOM

(76) Inventors: Methody W. Slobogean, 1135 Stevens Street, White Rock, British Columbia (CA) V4B 4X9; Fred P. Smith, 228 S. Scenic Dr., Alpine, UT (US) 84004; Todd Mendenhall, 11832 S. Kinney Cir., Riverton, UT (US) 84065; Nathan H. Morrill, 14227 Daisyfield Dr., Draper, UT (US) 84020

( * ) Notice: Subject to any disclaimer, the term of this patent is extended or adjusted under 35 U.S.C. 154(b) by 0 days.

(21) Appl. No.: 11/288,954

(22) Filed: Nov. 29, 2005

(65) Prior Publication Data

US 2006/0124570 A1 Jun. 15, 2006

Related U.S. Application Data

(60) Provisional application No. 60/631,280, filed on Nov. 29, 2004.

(51) Int. Cl.
*B66C 23/00* (2006.01)

(52) U.S. Cl. ..... 212/250; 254/386

(58) Field of Classification Search ..... 212/238, 212/250, 261, 292, 349; 254/385, 386
See application file for complete search history.

(56) References Cited

U.S. PATENT DOCUMENTS

| | | | | |
|---|---|---|---|---|
| 850,757 | A * | 4/1907 | Hutchings | 212/307 |
| 951,433 | A * | 3/1910 | Carey | 212/195 |
| 2,019,938 | A * | 11/1935 | Stephens | 212/261 |
| 2,911,111 | A * | 11/1959 | Grove | 212/349 |
| 3,265,218 | A * | 8/1966 | Stefanutti | 212/196 |
| 3,326,390 | A * | 6/1967 | Hackenberger | 212/231 |
| 3,348,701 | A * | 10/1967 | Mennerdahl | 212/250 |
| 3,836,025 | A * | 9/1974 | Olson et al. | 414/547 |
| 4,168,053 | A * | 9/1979 | Boenninghaus | 254/266 |
| 4,236,695 | A | 12/1980 | Morrison | |
| 4,296,819 | A | 10/1981 | Griste | |
| 4,392,574 | A | 7/1983 | Theyskens | |
| 4,458,785 | A | 7/1984 | Bushnell, Jr. | |
| 4,553,675 | A | 11/1985 | Kirk | |
| 4,585,132 | A | 4/1986 | Rathe et al. | |

(Continued)

FOREIGN PATENT DOCUMENTS

JP 9-58976 * 9/1997

OTHER PUBLICATIONS

Technocrane, "Cobra 4400H: PTO—Hydralic Cranes," Technocrane Cobra Series Product Pamphlet, (Jul. 27, 2005) pp. 1-2.

(Continued)

*Primary Examiner*—Thomas J Brahan
(74) *Attorney, Agent, or Firm*—Pate Pierce & Baird

(57) ABSTRACT

A crane comprising a boom formed as an elongate tubular structure and a line assembly to extend a line from a least one end of the boom. The line assembly may include a first bank of sheaves, a second bank of sheaves, a line reeved around the first and second banks of sheaves, and an extension mechanism controlling the distance between the first and second banks of sheaves. The second bank of sheaves and at least a portion of the extension mechanism being enclosed within boom.

20 Claims, 10 Drawing Sheets

U.S. PATENT DOCUMENTS

| | | | | |
|---|---|---|---|---|
| 4,592,474 | A | 6/1986 | Rathe | |
| 4,605,132 | A | 8/1986 | van Seumeren | |
| 4,688,690 | A * | 8/1987 | Gattu et al. | 212/349 |
| 4,951,924 | A | 8/1990 | Calkins | |
| 5,267,824 | A * | 12/1993 | Kishi | 414/718 |
| 5,456,567 | A | 10/1995 | Luebke | |
| 5,579,931 | A | 12/1996 | Zuehlke et al. | |
| 5,816,565 | A | 10/1998 | McGuffin | |
| 5,957,431 | A | 9/1999 | Serda, Jr. | |
| 6,296,232 | B1 | 10/2001 | Roodenburg | |
| 6,527,131 | B1 * | 3/2003 | Bröckelmann et al. | 212/292 |
| 6,651,961 | B1 | 11/2003 | Meyer | |

OTHER PUBLICATIONS

Technocrane, "Cobra 3300W: 12V-DC Electro Hydraulic Cranes," Technocrane Cobra Series Product Pamphlet, (Jul. 27, 2005), pp. 1-2.

Technocrane, "Cobra 10000H: PTO—Hydraulic Cranes," Technocrane Cobra Series Product Pamphlet, (Oct. 17, 2004), pp. 1-2.

Maxlift, "Series Cobra," Maxilift Product Pamphlet, (2004), pp. 1-6, USA.

Technocrane, "Maxilift: Series: M90W," Technocrane Maxilift Series Product Pamphlet, (Aug. 25, 2005), pp. 1-2.

Amco Veba Group, "828 A.V.P.S.," Amco Veba Product Pamphlet, (Mar. 2000), pp. 1-6.

Amco Veba Group, "SC," Amco Veba Product Pamphlet, (Oct. 2002), pp. 1-4.

* cited by examiner

Section A-A

ENCLOSED-REEVING, LIVE-LINE BOOM

RELATED APPLICATIONS

This application claims the benefit of co-pending U.S. Provisional Patent Application Ser. No. 60/631,280, filed Nov. 29, 2004 for LIVE LINE BOOM.

BACKGROUND

1. The Field of the Invention

This invention relates to lifting devices and, more particularly, to novel systems and methods related to live-line cranes.

2. The Background Art

Live-line lifting devices are machines capable of dispensing and retracting a length of line. Such devices are typically used to manipulate objects too massive to safely manipulate manually. Many current live-line lifting devices employ a winch that winds and unwinds a cable. These winches are typically driven by electric or hydraulic motors. Accordingly, they have certain disadvantages.

For example, spooling winches are typically expensive. They occupy a significant amount of space. They require stops to prevent the cable from being wrapped all the way on or off the spool. Moreover, spooling winches decrease in lifting capacity as the cable is wound onto the spool. That is, the winch produces a constant torque, but the moment arm acting against the winch increases as cable wraps around the spool and increases its diameter. Accordingly, current winch devices may begin lifting a heavy object, but fail or stall once the object has been lifted to a certain point. This increase in diameter also causes an increase in the speed at which cable is retracted, even while the winch operates at a constant rotational velocity Accordingly, what is need is a live-line lifting device that is compact and inexpensive to manufacture. Additionally, the device should dispense and retract line at a constant rate when desired. Moreover, the device should support the same maximum load at full retraction of the line that it can at full extension of the line.

BRIEF SUMMARY OF THE INVENTION

In view of the foregoing, in accordance with the invention as embodied and broadly described herein, a method and apparatus are disclosed in one embodiment of the present invention as including a crane comprising a boom, a base, and a line assembly. A boom may be formed as an elongate tubular structure. In certain embodiments, the boom may be extensible and include an extension and a housing. The extension may be shaped and sized to translate within the housing. A lock may be included to selectively fix the extension with respect to the housing to provide a desired overall length for the boom. In such embodiments, both the extension and the housing may be tubular structures closed on all sides or otherwise.

In general, a boom may extend generally horizontally. Accordingly a base may extend generally vertically to support the boom. In selected embodiments, a base may control the attitude of the boom. For example, a base may include a post and an extension mechanism. Both the post and the extension mechanism may pivotably engage the boom. Accordingly, by increasing or decrease the length of the extension mechanism, the angle of the boom with respect to the horizontal may be controlled.

A line assembly in accordance with the present invention may include a first bank of sheaves, a second bank of sheaves, an extension mechanism, and a line of one form or another. In selected embodiments, the first bank of sheaves may comprise a plurality of sheaves, each positioned to rotate about a particular axis. Similarly, the second bank of sheaves may comprise a plurality of sheaves, each positioned to rotate about a different axis. The extension mechanism may be positioned and configured to control the distance between the first and second banks of sheaves.

In selected embodiments, the line of the line assembly may having a first end, an intermediate portion, and a second end. The first end of the line may be connected to the boom. The intermediate portion of the line may be reeved between the first and second banks of sheaves. The second end of the line may be suspended from the boom proximate an end thereof. By controlling the distance between the first and second banks of sheaves (i.e., the elongation caused by the extension member) the length of line suspended from the boom may be controlled. Accordingly, the crane may be used as a live-line lifting device.

In certain embodiments, a boom may house the line assembly. That is, the line assembly may be enclosed within the tubular structure of the boom or one of its sub-components (e.g., the extension). In such embodiments, one of the first and second banks of sheaves may be designated an idling (stationary) bank. The other may be designated a working (moving) bank. The idling bank may be fixed with respect to the boom. The working bank, on the other hand, may be free to travel longitudinally within the boom at the impetus of the extension member of the line assembly.

By housing the line assembly within the boom, the tubular structures of the boom may maintain the proper alignments and connections of the line assembly as it extends and retracts. The boom may increase the safety of the crane by provide a shroud limiting access to the line assembly with its moving parts and pinch points. Additionally, the aesthetics of the crane may be improved by providing a simple and compact profile, decreasing exposure of cables (wire rope) to weather and rust, hiding greasy components, and so forth.

Accordingly, a crane in accordance with the present invention may provide a live-line lifting device where the speed at which line is consumed or dispensed may be directly proportional to the speed at which the extension mechanism of the line assembly changes the distance between the idling and working banks. Thus, if the extension mechanism of the line assembly changes length at a constant rate, the line will be dispensed at a constant rate. Additionally, virtually any load that may be supported by a crane in accordance with the present invention at the full extension of the line may also be supported at full retraction of the line.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF ILLUSTRATED EMBODIMENTS

Figure 1:
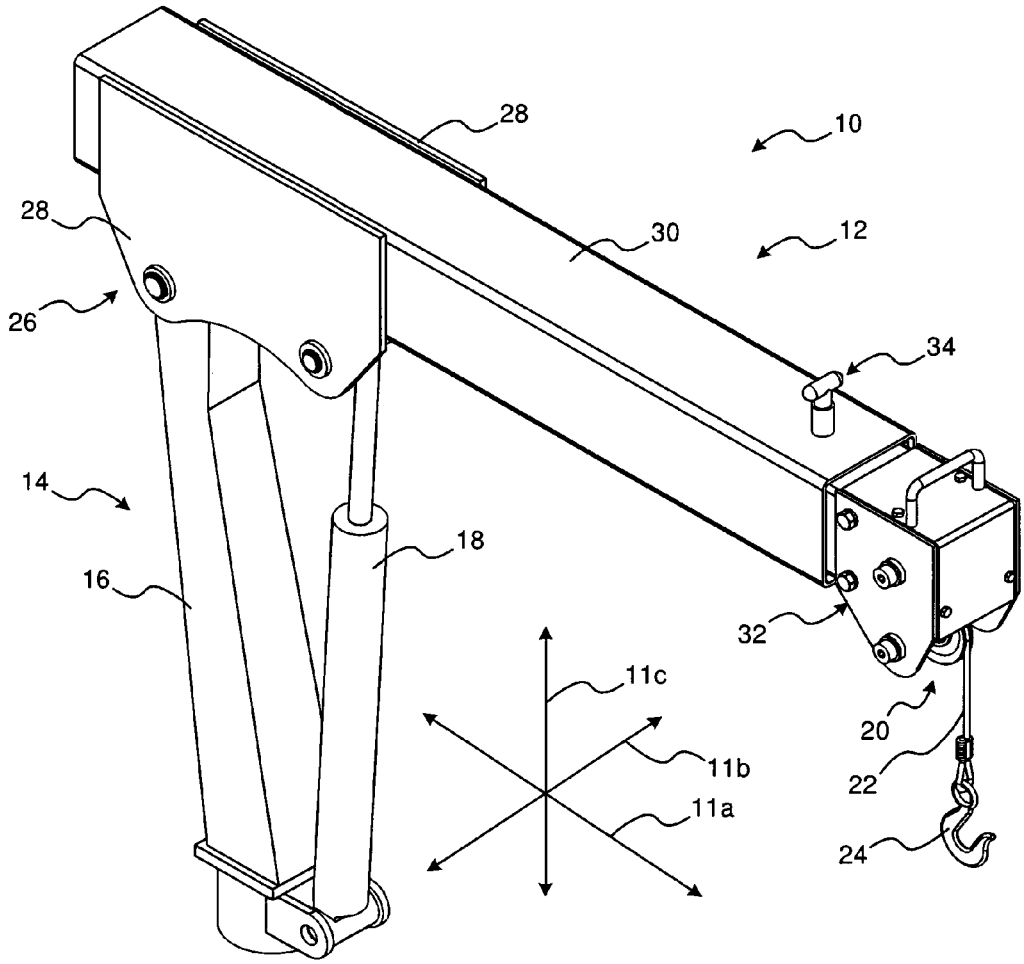
FIG. 1 is an isometric view of a crane in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, in describing a crane 10 in accordance with the present invention, it may be advantageous to first define longitudinal 11*a*, lateral 11*b*, and transverse 11*c* directions substantially orthogonal to one another. In general, the longitudinal direction 11*a* may be aligned with the longest dimension of the crane 10. The lateral direction 11*b* may extend from side to side. Accordingly, the transverse direction 11*c* may be aligned vertically.

The various structures on a crane 10 in accordance with the present invention may be selected and arranged to perform various functions. For example, in typical use, a crane 10 may raise and lower objects of significant weight (e.g., humanly impossible, unhealthy, or unsafe to lift directly). Accordingly, a crane 10 may include a boom 12 supported by a base 14. In general, a boom 12 may extend in the longitudinal direction 11*a*, while the base 14 extends in the transverse direction 11*c*.

In selected embodiments, a base 14 may pivotably secure the boom 12 to control the attitude thereof. For example, in some embodiments, a base 14 may include a post 16 and an extension mechanism 18 (e.g. a hydraulic cylinder 18 or the like). Both the post 16 and the extension mechanism 18 may pivotably engage the boom 12. Accordingly, by increasing or decrease the length of the extension mechanism 18, the angle of the boom 12 with respect to the horizontal may be controlled. In some embodiments, a base 14 may be supported by a foundation fixable with respect to the ground. In certain embodiments, the foundation may comprise a turntable permitting the base to rotate about a substantially vertical axis.

In certain embodiments, a boom 10 may house a line assembly 20. In operation, the line assembly 20 may extend and retract a line 22 (e.g., a rope 22, wire rope 22, a metallic cable 22, two of these or the like). For example, when the line 22 is retracted into the boom 10, a hook 24 may be pulled toward the boom 10. Thus, any load connected to the hook 24 may be lifted. Alternatively, when the line 22 is dispensed from the boom 10, the hook 24 and any load attached thereto may be lowered away from the boom 10.

A boom 12 in accordance with the present invention may include an interface 26 facilitating engagement with the base 14. In selected embodiments, an interface 26 may include one or more interface plates 28. The plates 28 may extend to engage the base 14.

Figure 2:
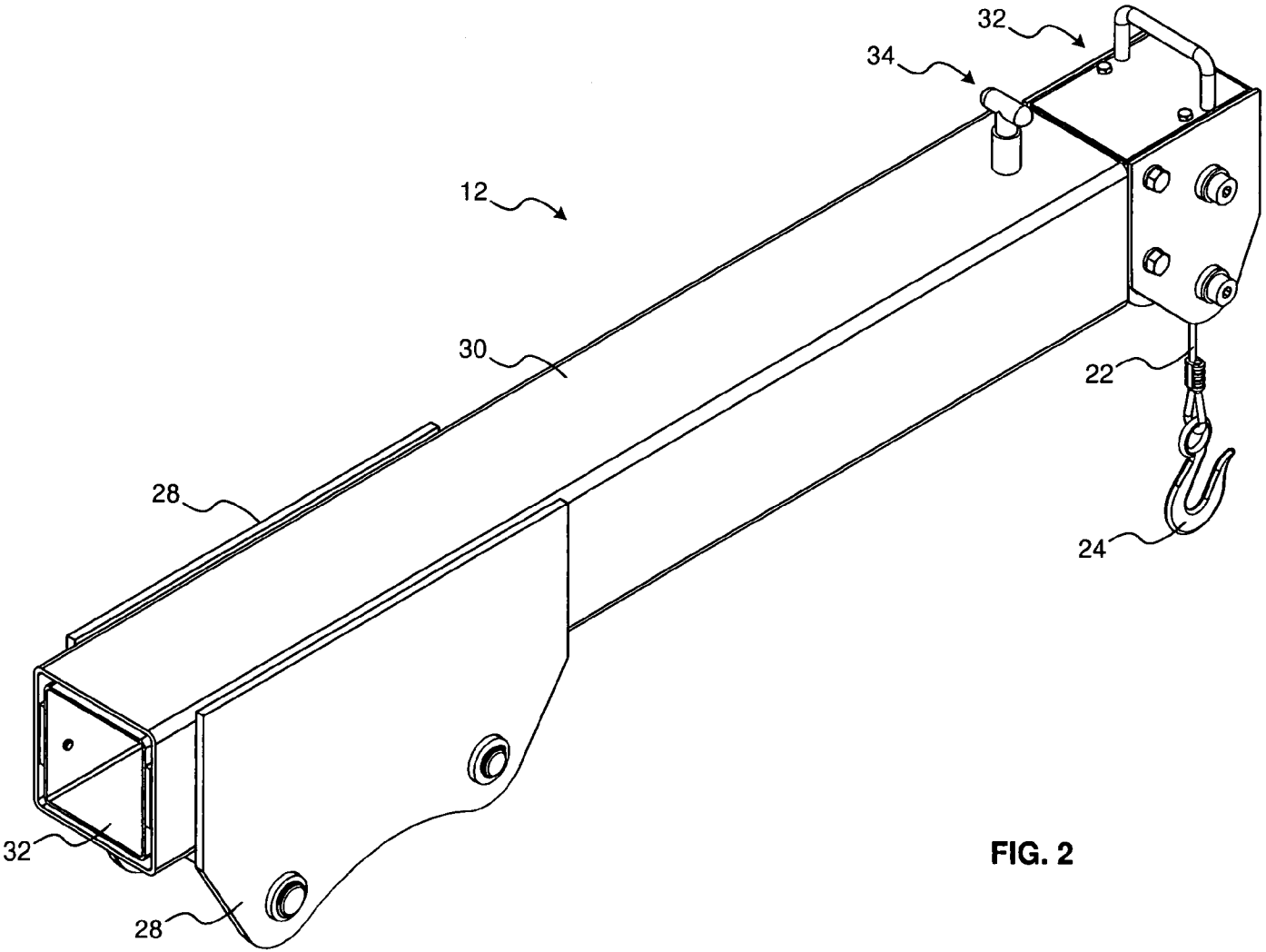
FIG. 2 is an isometric view of the boom from the crane illustrated in FIG. 1.

Referring to FIGS. 1 and 2, in selected embodiments, a boom 12 may be adjustable in length to control the reach of the boom 12. For example, in some embodiments, a boom 12 may include a housing 30 and an extension 32. The extension 32 may be shaped and sized to translate within the housing 30. Accordingly, an extension 32 may translated between a fully extending position providing a maximum length for the boom 12 and a fully retracted position (as illustrated) providing a minimum length for the boom 12. In such embodiments, a boom 10 may include a lock 34 selectively fixing the position of the extension 32 with respect to the housing 30. An extension 32 in accordance with the present invention may be mounted in many different configurations to a variety of other mounting and supporting structures.

A housing 30 in accordance with the present invention may have any suitable configuration. In selected embodiments, a housing 30 may be tubular and have a rectangular cross-section. An extension 32 may have a shape corresponding to the shape of the housing 30. Accordingly, in embodiments where the housing 30 is tubular with a rectangular cross-section, the extension 32 may also be tubular with a rectangular cross-section.

Figure 3:
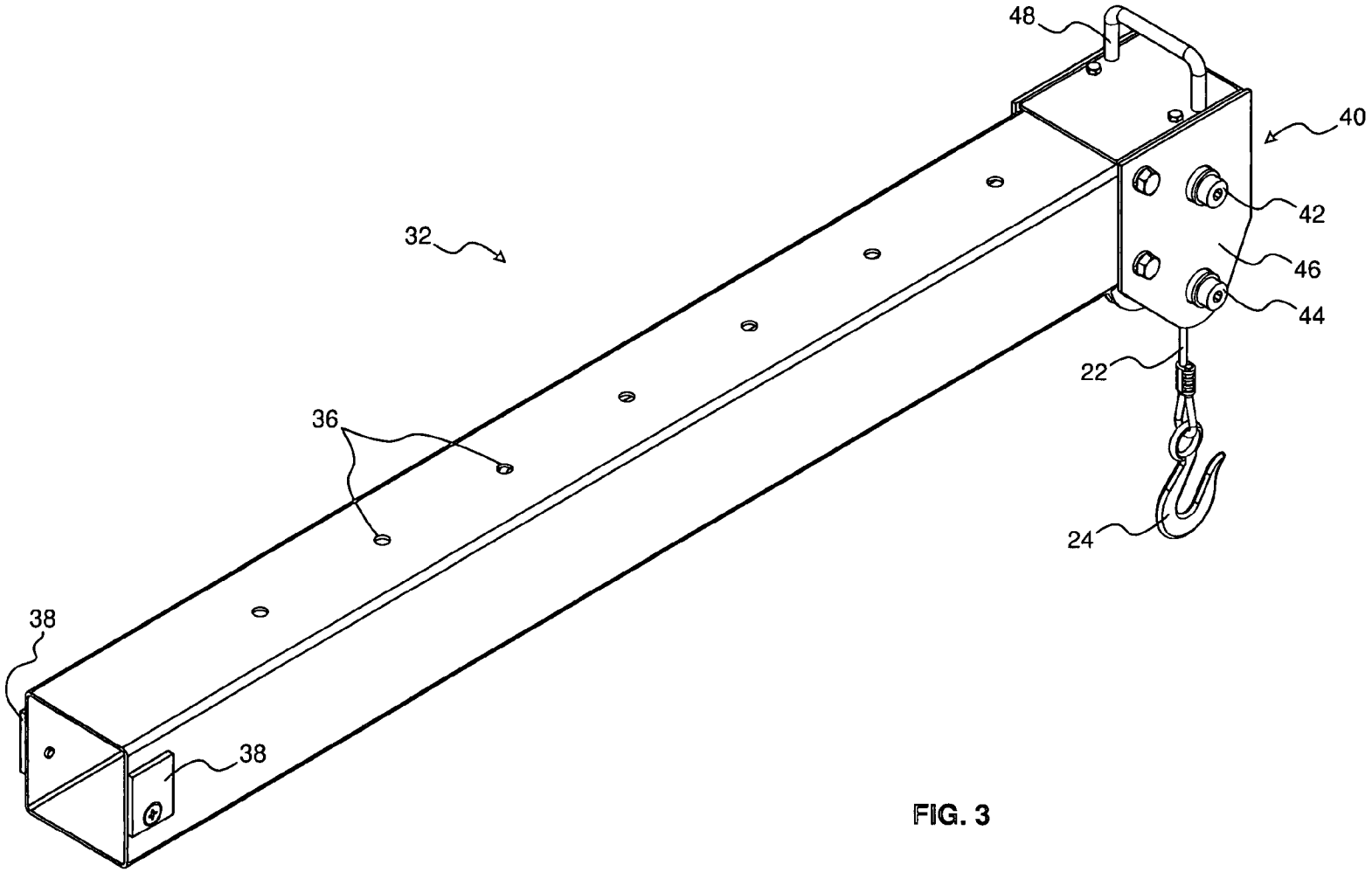
FIG. 3 is an isometric view of the extension portion of the boom illustrated in FIG. 2.
Figure 4:
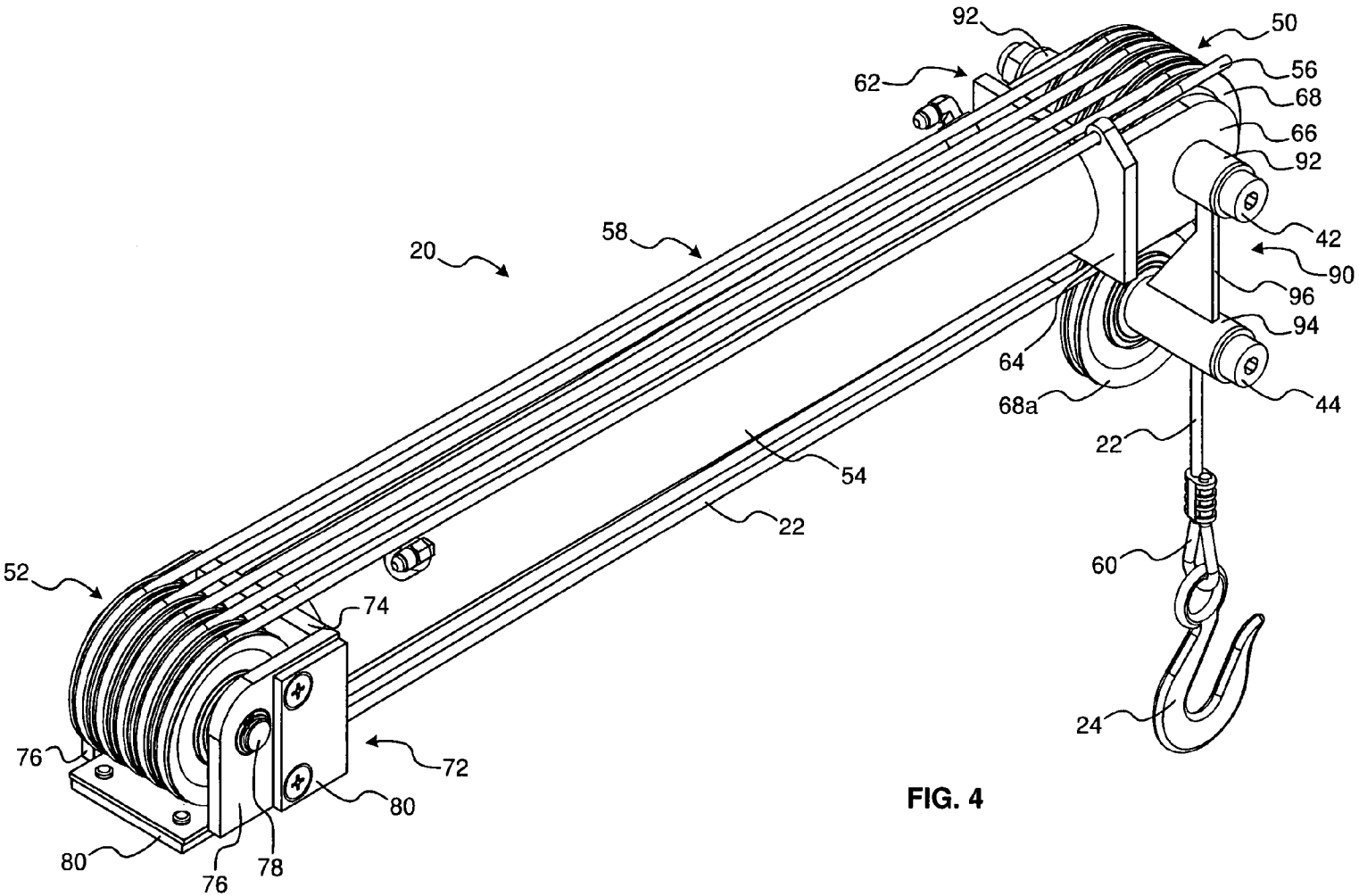
FIG. 4 is an isometric view of a line assembly in accordance with the present invention.
Figure 5:
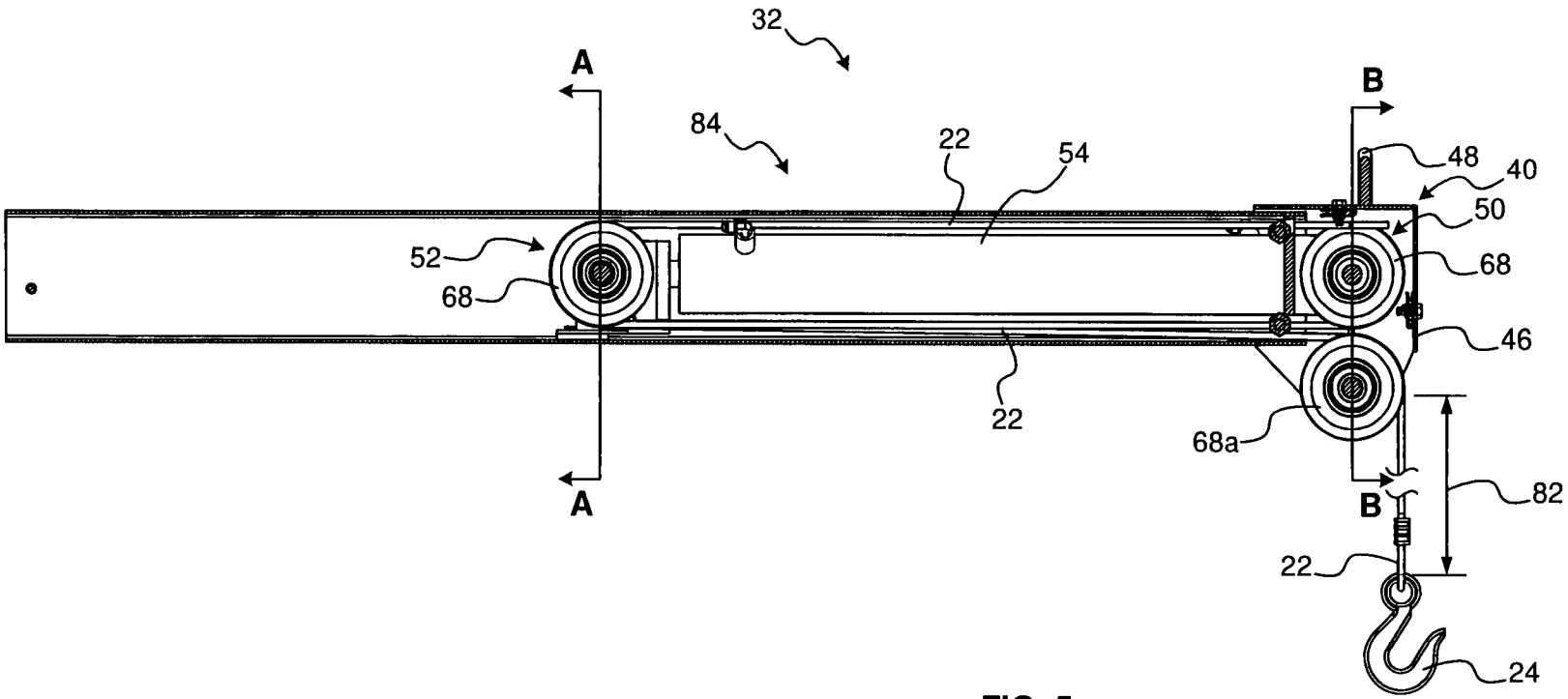
FIG. 5 is a cross-sectional side view of the line assembly of FIG. 4 positioned within the extension portion of the boom, the line from the line assembly being extended in accordance with the present invention.
Figure 6:
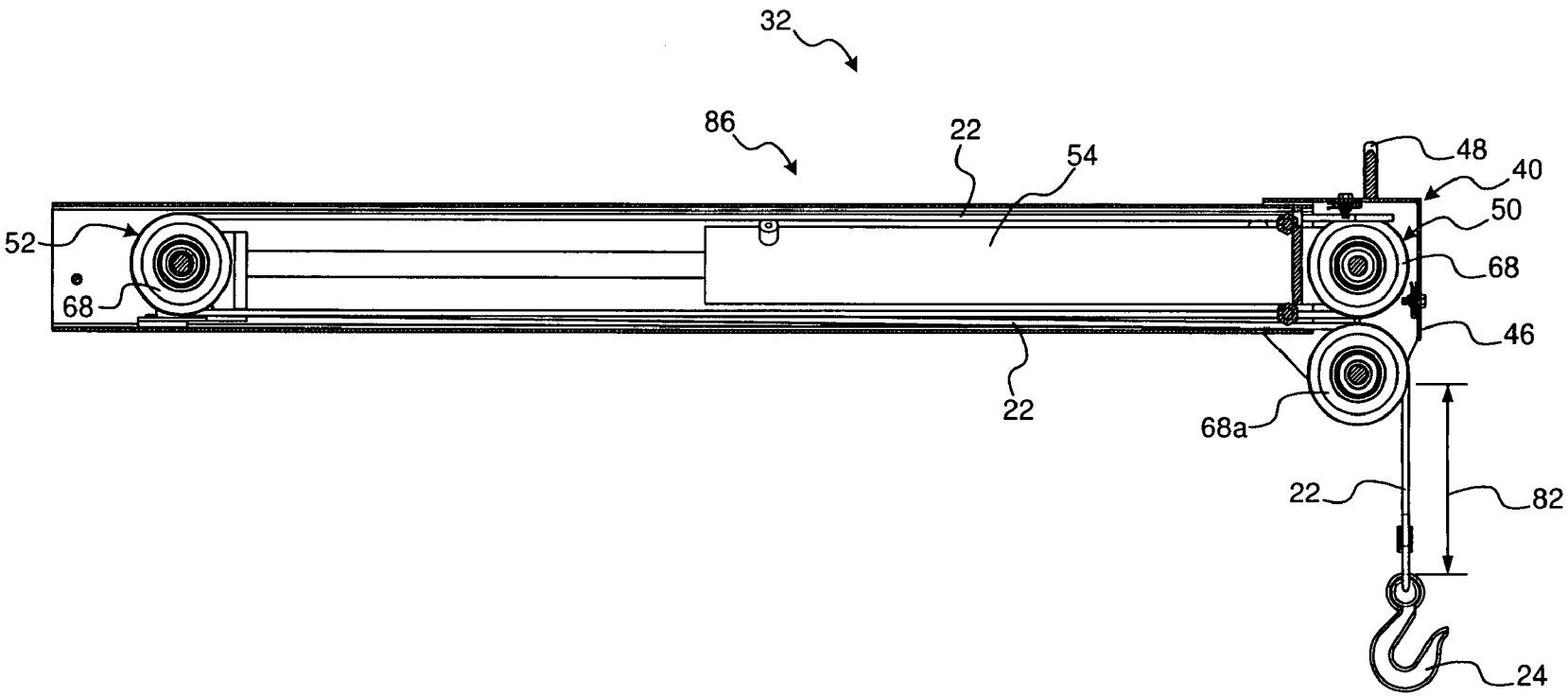
FIG. 6 is a cross-sectional side view of the line assembly of FIG. 4 positioned within the extension portion of the boom, the line from the line assembly being retracted in accordance with the present invention.
Figure 7:
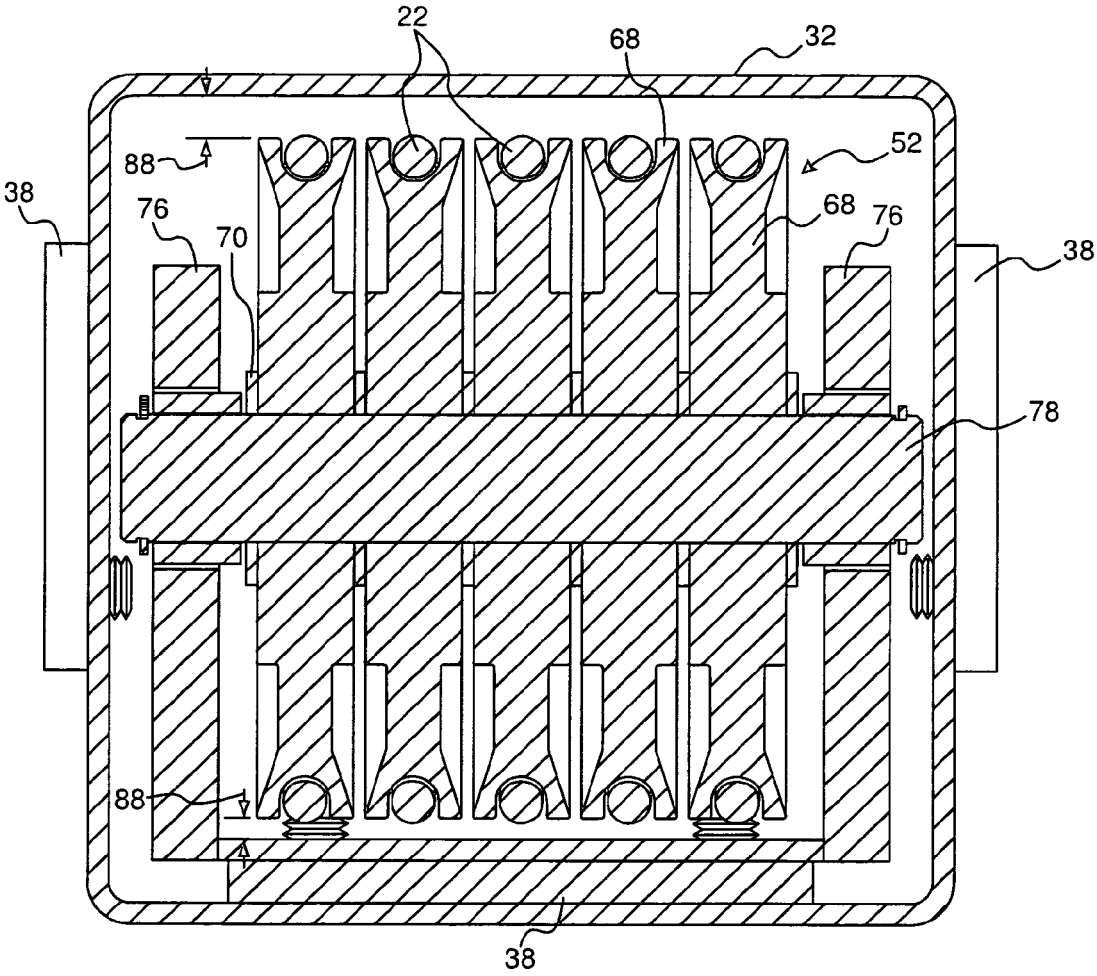
FIG. 7 is a cross-sectional end view of working bank of sheaves secured by a working housing to travel within the extension portion of the boom.
Figure 8:
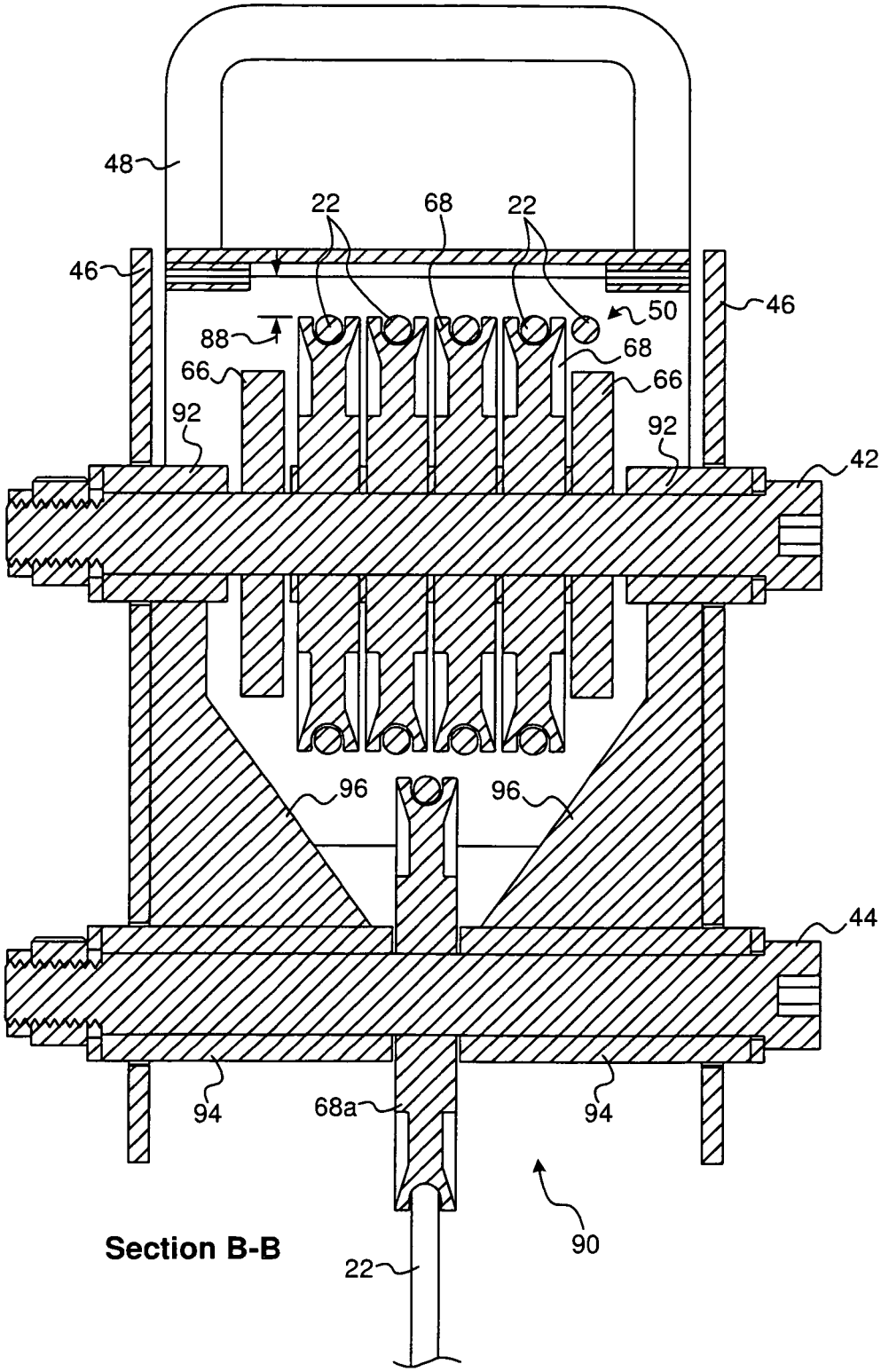
FIG. 8 is a cross-sectional end view of idling bank of sheaves secured by a idling housing and positioned with the shroud of the extension portion of the boom.

Referring to FIG. 3, a lock 34 in accordance with the present invention may operate in any suitable manner. For example, in selected embodiments, a lock 34 may include a shear pin located on the housing 30 and biased toward engagement with various apertures 36 located in the extension 32. Accordingly, to disengage the lock 34, an operator may manually withdraw the shear pin from the aperture 36. The operator may then translate the extension within the housing 30 until the shear pin aligns with a desired aperture 36. Accordingly, the shear pin may be manually or automatically inserted through the aligned aperture 36 and again fix the extension 32 with respect to the housing 30.

In selected embodiments, an extension 32 may include one or more slide plates 38. These slide plates 38 may be positioned to fill certain gaps between the extension 32 and the housing 30. Accordingly, the slide plates 38 may control undesirable motion (e.g., rattling or the like) of the extension 32 by biasing it or capturing it closely within the housing 32. Additionally, the slide plates 38 may be selected and positioned to reduce frictional forces as an extension 32 is translated within a housing 30. In selected embodiments, slide plates 38 may be formed of a friction reducing material such as brass, high density polyethylene (HDPE), or the like.

In embodiments having an inextensible boom 12, that boom may be patterned after the extension 32 described herein. That is, in selected embodiments, the boom 12 may have a single tubular body and include interface plates 28 for engaging the base 14.

In certain embodiments, an extension 32 may house the line assembly 20. Accordingly, an extension 32 may include a line assembly interface 40 connecting the line assembly 20 to the rest of the extension 32. For example, a line assembly 20 may include one or more sheaves rotating about one or more rods 42, 44. A line assembly interface 40 may include one or more apertures to received such rods 42, 44. Accordingly, in some embodiments, securing the rods 42, 44, the line assembly interface 40 may effectively connect the line assembly 20 to the extension 32. Multiple lines and multiple assemblies 20 in a boom may permit, for example a motor lift (hoist) to receive both support and electrical power through two separate lines. What is true for a single bank of sheaves may typically be done in multiple banks, typically in parallel.

Additionally, a line assembly interface 40 may provide a shroud 46 covering the sheaves. The shroud 46 may protect the sheaves as well as any object (e.g., hand, finger, or the like) that may otherwise become entangled therewith. A line assembly interface 40 may also include a handle 48. The handle 48 may facilitate manual translation of the extension 32 within the housing 30. Additionally, the handle 48 may provide a location where a static lift line may be secured to the boom 12.

Referring to FIGS. 4-8, a line assembly 20 in accordance with the present invention may include a first bank of sheaves 50, a second bank of sheaves 52, and an extension mechanism 54 (e.g., a hydraulic cylinder 54 or the like) controlling the distance between the first and second banks of sheaves 52, 54. In general, the first bank of sheaves 50 may be characterized as an idling bank 50, as it may be fixed with respect to the boom 12. The second bank of sheaves 52 may be characterized as a working bank 52, as it may travel back and forth under the impetus of the extension mechanism 54. In selected embodiments, an extension 32 may be sized and shaped to guide the working bank 52 as it is manipulated by the extension mechanism 54.

In selected embodiments, an extension mechanism 54 in accordance with the present invention may be embodied as a hydraulic cylinder. In such embodiments, certain hydraulic hoses may be require access to the cylinder. Such hoses may extend to reach the cylinder in any suitable manner, whether internally or externally with respect to the boom 12 and base 14. In selected embodiments, the base 14 (e.g., post 16) may act a repository housing hose (e.g., flexible hose) sufficient to accommodate any travel of the extension 32 within the housing 30.

A line 22 may include a first end 56, an intermediate portion 58, and a second end 60. The first end 56 of the line 22 may be fixed with respect to the boom 12. The intermediate portion 58 of the line 22 may be reeved between the idling and working banks 50, 52. The second end 60 of the line 22 may be suspended from the boom 12.

In selected embodiments, the idling bank 50 may be secured, maintained in position, and connected to the extension mechanism 54 by an idling housing 62. In some embodiments, the idling housing 62 may be secured to the extension 32 by one or more removable fasteners. The idling housing 62 may include a base plate 64, two cheek plates 66, and a rod 42.

The base plate 64 may provide the interface between the cheek plates 66 and the extension mechanism 54. Additionally, the base plate 64 may provide a location for securing the first end 56 of the line 22. The cheek plates 66 may be positioned adjacent the lateral faces of the idling bank 50. The rod 42 (e.g., a shoulder bolt 42 or the like) may pass through the cheek plates 66 to capture the various sheaves 68 forming the idling bank 50. If desired or necessary, the rod 42 of an idling housing 62 may also support one or more washers 70 positioned to appropriately space the various sheaves 68. In some embodiments, the sheaves 68 may include bearings to facilitate rotation about the rod 42.

In selected embodiments, the working bank 52 may be secured together and connected to the extension mechanism 54 by working housing 72. The working housing 72 may include a base plate 74, two cheek plates 76, and a rod 78. The base plate 74 may provide the interface between the cheek plates 76 and the extension mechanism 54. Additionally, the base plate 74 may provide a location for securing the first end 56 of the line 22.

The cheek plates 76 may be positioned adjacent the lateral faces of the working bank 52. The rod 78 (e.g., a shoulder bolt 78 or the like) may pass through the cheek plates 76 to capture the various sheaves 68 forming the working bank 52. If desired or necessary, the rod 78 of working housing 72 may also support one or more washers 70 positioned to appropriately space the various sheaves 68. The sheaves 68 may include bearings facilitating rotation about the rod 78.

In certain embodiments, slide pads 80 may be included as part of the working housing 72. The slide pads 80 may be positioned to contact with the inner walls of the boom 12 (e.g., extension 32). Accordingly, the pads 80 may provide a bearing surface as the working housing 72 travels back and forth within the boom 12. In selected embodiments, the slide pads 80 may be selected and positioned to reduce frictional forces. For example, slide pads 80 may be formed of a friction reducing material such as brass, high density polyethylene (HDPE), or the like.

Additionally, the slide pads 80 may control undesirable motion of the working housing 72 within the boom 12. For example, the pads 80 may assist in aligning the working bank 72 within the boom 12 and resist rotation of the extension mechanism 54.

In operation, as an extension mechanism 54 increases and decreases the distance between the idling and working banks 50, 52, the length of line 22 necessary to pass from one bank 50, 52 around the other 52, 50 and back correspondingly increases or decreases. As a result, the amount of line 22 remaining that may be suspended from the boom 12 may be controlled.

The speed at which line 22 is consumed or dispensed from a line assembly 20 may be directly proportional to a multiple of the speed at which the extension mechanism 54 changes the distance between the idling and working banks 50, 52. The multiple may be selected with load capacity when selecting or designing line size. Additionally, the loads that may be supported by a line assembly 20 may be constant throughout the entire range of operation. That is, any load that may be supported by a line assembly 20 at the full extension of the line 22 may be supported by that line assembly 20 at full retraction of the line 22. Moreover, if the speed of extension or retraction of the extension mechanism 54 is constant through its range of operation, then the speed of retraction and extension of the line 22 will be constant through its range of operation.

The number of sheaves 68 within the idling and working banks 50, 52 may vary from embodiment to embodiment. An increase in the number of sheaves 68 may produce an increase in the number of times a line 22 may be wrapped from one bank 50, 52 around the other 52, 50 and back. As a result, in general, the greater the number of sheaves 68, the greater the difference in the length 82 of suspended line 22 between the fully retracted position 84 and the fully extended position 86.

In certain embodiments, the number of sheaves 68 contained in the idling and working banks 50, 52 may be constrained by the size of the boom 12 into which the line assembly 20 will be installed. In other embodiments, the number of sheaves 68 contained in the idling and working banks 50, 52 may be constrained by the maximum force that may safely be generated by the extension mechanism 54. That is, by reeving a line 22 about the idling and working banks 50, 52, the extension mechanism 54 may be forced to work against a mechanical disadvantage equaling some multiple of the tension within the line 22. Accordingly, at some point, additional wraps of the line 22 may cause an extension mechanism 54 to be loaded beyond its capacity.

In one embodiment, a line assembly 20 where the idling and working banks 50 each include about four to five sheaves 68 may be included within a boom 12 of reasonable size. Additionally, a line assembly 20 where the idling and working banks 50 each include about four to five sheaves 68 may provide sufficient change in the length 82 of line 22 suspended from a boom 12 to function adequately (e.g., about twice the stroke per sheave pair). Moreover, a line assembly 20 where the idling and working banks 50 each include about four to five sheaves 68 may not overly disadvantage the extension mechanism 54 to a point where it cannot lift expected loads.

In selected embodiments, in may be desirable or necessary to limit the ability of the line 22 to exit certain sheaves 68. Accordingly, a crane 10 in accordance with the present invention may include any mechanism designed to maintain the line 22 within the grooves of the sheaves 68. In certain embodiments, the clearance 88 between certain sheaves 68 and the surrounding structures (e.g., the main tube of the extension 32, the shroud 46, or the like) may be selected to resist exit of the line 22. That is, the clearance 88 may be sufficiently small that the line 22 cannot pass therethrough and, therefore, must remain in the groove of the sheave 68.

Alternatively, one or more additional structures may be included within a crane 10 to artificially create a small clearance 88. For example, in one embodiment, a rod may pass in the lateral direction 11*b* through the shroud 46, working housing 72, or the like at a location selected to maintain the line 22 within the respective grooves of the sheaves 68.

In certain embodiments, a line assembly 20 in accordance with the present invention may include a lifting sheave 68*a*. In some embodiments, a lifting sheave 68*a* may be positioned proximate a distal end of the boom 12 to guide the line 22 in and out of the boom 12. In one embodiment, a lifting sheave 68*a* may be positioned below the idling bank 50. In such an embodiment, the lifting sheave 68*a* may be mounted on a rod 44. A brace 90 may connect the rod 44 corresponding to the lifting sheave 68*a* to the rod 42 corresponding to the idling bank 50.

In selected embodiments, a brace 90 may include upper spacers 92, lower spacers 94, and a webbing 96 connecting the upper spacer 92 on each side with the lower spacer 94 corresponding to that side. In some embodiments, each upper spacer 92 may surround the rod 42 laterally outside of the cheek plates 66 of the idling housing 50. Similarly, each lower spacer 94 may surround the rod 44 on each side of the lifting sheave 68. Accordingly, the webbing 96 may extend from the upper spacers 92 to the lower spacers 94.

Figure 9:
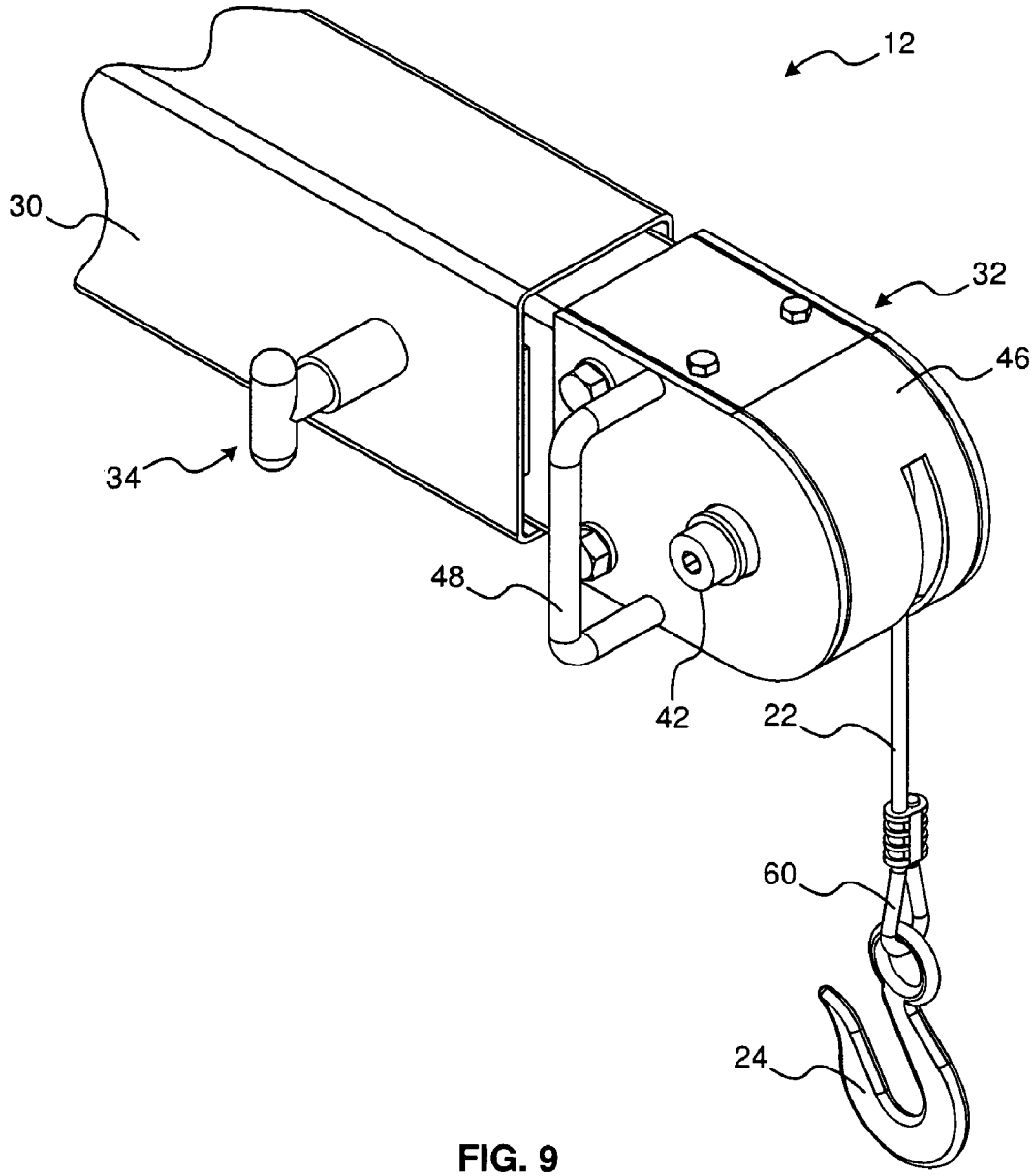
FIG. 9 is a partial isometric view of an alternative embodiment of a shroud and idling bank arrangement in accordance with the present invention.

Referring to FIG. 9, in selected embodiments, a lifting sheave 68*a* may be omitted. In such embodiments, the line 22 may be suspended directly from a sheave 68 of the idling bank 50. In such embodiments, if desired or necessary, an additional sheave 68 may be added to the idling bank 50 to provide the same line retraction and extension capabilities that may be associated with embodiments including a separate lifting sheave 68*a*. Additionally, the configuration of the shroud 46 may be adjusted to fit the new geometry of the idling bank 50.

Figure 10:
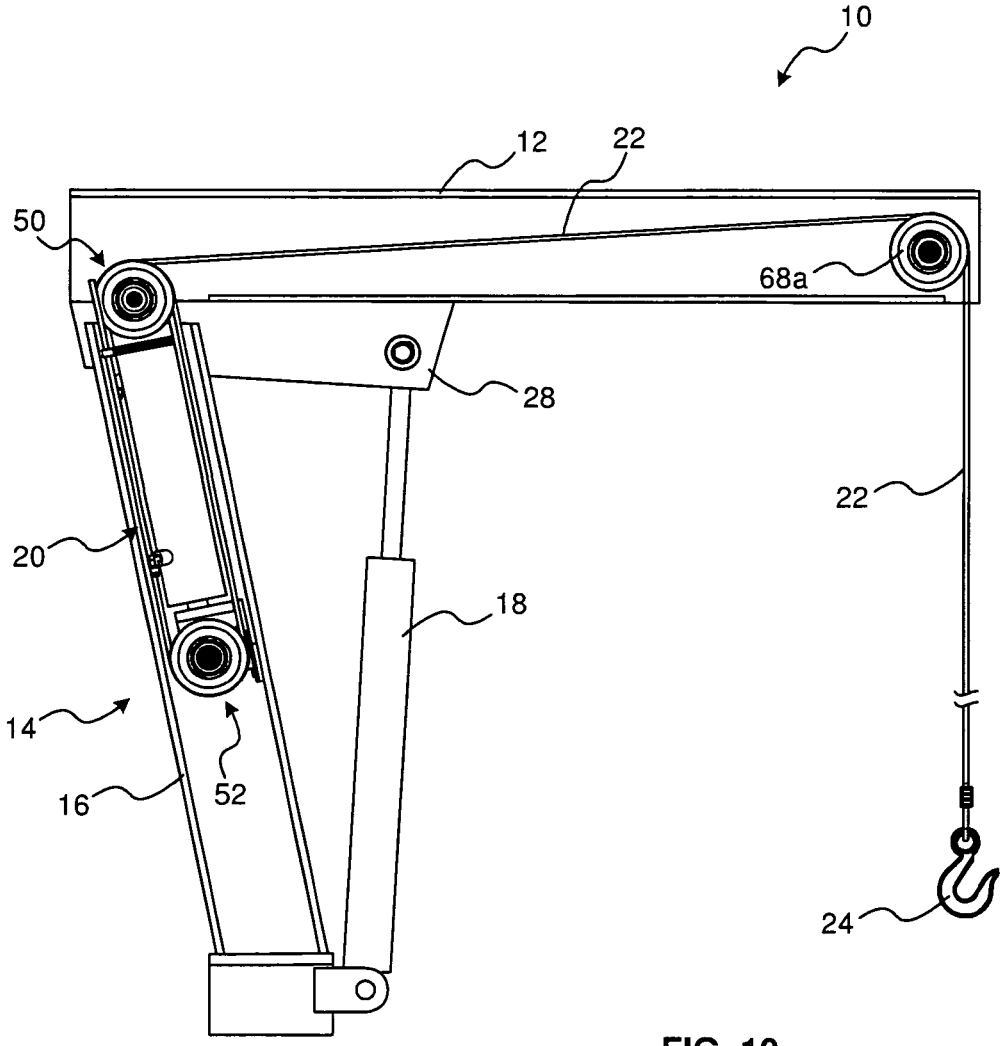
FIG. 10 is cross-sectional side view of an alternative embodiment of a crane in accordance with the present invention where the line assembly is positioned within a post of the base, rather than within the boom.

Referring to FIG. 10, in selected embodiments, a line assembly 20 in accordance with the present invention may be positioned somewhere other than within the boom 12. For example, in selected embodiments, a line assembly 20 may be positioned within the base 14 (e.g., a post 16). Accordingly, an extension mechanism 54 may selectively translate the working bank 52 within the confines of the base 14. In such embodiments, a lifting sheave 68*a* may be positioned at the distal end of the boom 12 to guide the line 22 into and out of the boom 12. In selected embodiments, a crane 10 having the line assembly 20 positioned within the base 14 may still include an extendable boom 12 through which the line passes for use. Accordingly, a boom 12 in such embodiments may include a housing 30 and an extension 32.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A crane comprising:

a boom comprising an elongate tubular structure having two ends defining a longitudinal direction and an interior space;

a line assembly formed as a self-supporting, modular unit inserted in the longitudinal direction into the boom; and the line assembly extending a line from a depending lifting sheave at one end of the boom and comprising:

a first bank of sheaves, comprising a base with a height and width corresponding to a lateral cross-section of the internal space;

a second bank of sheaves comprising a housing with at least one slide pad;

the line reeved around the first and second banks of sheaves;

a first hydraulic cylinder controlling the distance between the first and second banks of sheaves; and the second bank of sheaves and at least a portion of the first hydraulic cylinder being enclosed within the elongate tubular structure, the base being inextensibly fixed in the longitudinal direction with respect to the boom.

2. The apparatus of claim 1, wherein the first hydraulic cylinder extends and retracts in the longitudinal direction.

3. The apparatus of claim 2, wherein the second bank of sheaves is spaced in the longitudinal direction from the first bank of sheaves.

4. The apparatus of claim 3, wherein the first bank of sheaves comprises a first plurality of sheaves, each sheave of the first plurality of sheaves being positioned to rotate about a first axis substantially orthogonal to the longitudinal direction.

5. The apparatus of claim 4, wherein the second bank of sheaves comprises a second plurality of sheaves, each sheave of the second plurality of sheaves being positioned to rotate about a second axis substantially parallel to and spaced from the first axis.

6. The crane of claim 5, wherein the elongate tubular structure comprises a tubular housing, a tubular extension, and a lock, the tubular extension positioned within the tubular housing to translate therewithin in the longitudinal direction, the lock selectively fixing the tubular extension longitudinally with respect to the tubular housing.

7. The crane of claim 6, wherein the second bank of sheaves and at least a portion of the first hydraulic cylinder are positioned within the tubular extension.

8. The crane of claim 7, further comprising a post pivotably connecting the boom to a foundation fixable with respect to the ground.

9. The crane of claim 8, further comprising a second hydraulic cylinder selectively pivoting the boom with respect to the post.

10. The crane of claim 9, wherein the line is a wire rope having a first end secured to the boom, an intermediate portion reeved between the first and second banks of sheaves, and a second end suspended from the boom proximate one end thereof, and the tubular structure is substantially closed and continuous throughout its length about a circumference thereof.

11. An apparatus comprising:

a boom extending in a longitudinal direction and comprising a housing, an extension, and a lock, the extension and an interior space positioned inside the housing to translate therewithin and extend therefrom in the longitudinal direction, the lock selectively securing the extension with respect to the housing;

a line assembly formed as a self-supporting, modular unit inserted in the longitudinal direction into the extension; and the line assembly extending a line from a depending lifting sheave at one end of the extension and comprising:

a first bank of sheaves, comprising a base with a height and width corresponding to a lateral cross-section of the internal space;

a second bank of sheaves comprising a housing with at least one slide pad;

the line reeved around the first and second banks of sheaves;

a hydraulic cylinder controlling the distance between the first and second banks of sheaves; and the second bank of sheaves and at least a portion of the hydraulic cylinder being enclosed within the extension, the base being inextensibly fixed in the longitudinal direction with respect to the boom.

12. The apparatus of claim 11, wherein the hydraulic cylinder extends in the longitudinal direction.

13. The apparatus of claim 12, wherein the first bank of sheaves comprises a first plurality of sheaves, each sheave of the first plurality of sheaves being positioned on a first axle to rotate thereabout.

14. The apparatus of claim 13, wherein the first axle extends orthogonally to the longitudinal direction.

15. The apparatus of claim 14, wherein the second bank of sheaves comprises a second plurality of sheaves, each sheave of the second plurality of sheaves being positioned on a second axle to rotate thereabout.

16. The apparatus of claim 15, wherein the second axle extends perpendicularly with respect to the longitudinal direction.

17. The apparatus of claim 16, wherein the at least a portion of the hydraulic cylinder comprises substantially all of the hydraulic cylinder.

18. The apparatus of claim 16, wherein the line assembly further comprises a wire rope reeved between the first and second banks of sheaves.

19. The apparatus of claim 18, wherein the wire rope comprises steel and the extension is substantially continuous and closed along its length about a circumference normal thereto.

20. An apparatus comprising:

a boom extending to define a longitudinal direction and comprising a tubular housing, a tubular extension, and a lock, the tubular extension having an interior space and positioned inside the tubular housing to translate therewithin and extend therefrom in the longitudinal direction, the lock comprising a shear pin selectively securing the tubular extension with respect to the tubular housing;

a post pivotably supporting the boom;

a first hydraulic cylinder controlling the position of the boom with respect to the post;

a cable assembly formed as a self-supporting, modular unit inserted in the longitudinal direction into the tubular extension and comprising:

a first bank of sheaves, comprising a base with a height and width corresponding to a lateral cross-section of the internal space;

a second bank of sheaves spaced in the longitudinal direction from the first bank of sheaves and comprising a housing with at least one slide pad;

a second hydraulic cylinder controlling the distance between the first and second banks of sheaves; and the second bank of sheaves and at least a portion of the second hydraulic cylinder being positioned with the tubular extension, the base being inextensibly fixed in the longitudinal direction with respect to the boom; and a cable having a first end, an intermediate portion and a second end, the first end connected to the cable assembly, the intermediate portion reeved between the first and second banks of sheaves, the second end suspended from a depending lifting sheave.

* * * * *